US009254025B2

(12) United States Patent
McClain

(10) Patent No.: US 9,254,025 B2
(45) Date of Patent: Feb. 9, 2016

(54) USER HEAD SUPPORT APPARATUS FOR A WASH BASIN

(71) Applicant: Patrick James McClain, Galveston, TX (US)

(72) Inventor: Patrick James McClain, Galveston, TX (US)

( * ) Notice: Subject to any disclaimer, the term of this patent is extended or adjusted under 35 U.S.C. 154(b) by 100 days.

(21) Appl. No.: 14/220,350

(22) Filed: Mar. 20, 2014

(65) Prior Publication Data

US 2015/0265021 A1 Sep. 24, 2015

(51) Int. Cl.
*A45D 19/10* (2006.01)
*A45D 44/10* (2006.01)

(52) U.S. Cl.
CPC ..... *A45D 19/10* (2013.01); *A45D 44/10* (2013.01)

(58) Field of Classification Search
CPC ..... A47D 44/10; A47D 44/02; A47K 3/125; A47G 9/1009
USPC ..... 4/522, 523, 575.1, 61, 586, 589, 621, 4/515; 297/397, 391; 248/118; 5/640, 5/643
See application file for complete search history.

(56) References Cited

U.S. PATENT DOCUMENTS

| | | | | | |
|---|---|---|---|---|---|
| 570,107 | A * | 10/1896 | Bailey | 4/523 |
| 1,260,929 | A * | 3/1918 | Maxcy | 297/394 |
| 1,588,293 | A * | 6/1926 | Bailey | 4/523 |
| 2,453,784 | A * | 11/1948 | Conjurske | 4/522 |
| 3,026,537 | A * | 3/1962 | Schnell | 4/621 |
| 4,498,204 | A * | 2/1985 | Warner | 4/559 |
| 4,674,472 | A * | 6/1987 | Reis | 124/89 |
| 5,692,251 | A * | 12/1997 | Page | 4/523 |
| 6,270,160 | B1 * | 8/2001 | Blake | 297/393 |
| 2012/0084912 | A1 * | 4/2012 | Barman | 4/621 |

* cited by examiner

*Primary Examiner* — Lauren Crane
*Assistant Examiner* — Erin Deery
(74) *Attorney, Agent, or Firm* — Plager Schack LLP

(57) ABSTRACT

A support apparatus for a head of a user placed in a wash basin maintains the neck of the user in a neutral position, thereby minimizing head or neck injuries. The support apparatus includes a base member with a cushion member to receive the head of the user and a support arm to contact a side wall of the wash basin, a leg member with a shaft rotatably mounted to the base member, the leg member able to adjust so the distance between the base member and the leg member is sufficient to enable the bottom portion of the leg member to be in contact with a drain of the wash basin, and a locking mechanism slidably mounted to the shaft to secure the leg member to the base member.

3 Claims, 4 Drawing Sheets

USER HEAD SUPPORT APPARATUS FOR A WASH BASIN

BACKGROUND

The embodiments herein relate generally to apparatuses to support a user's head in a wash basin.

In hair salons or barber shops, customers often wash their hair in a wash basin or sink. During the cleaning process, users sit down and their heads recline into the wash basin. This position is undesirable because the user's head hyperextends downward into the wash basin, causing the user's neck to tilt out of a neutral and aligned position. As a result, the user may injure or strain the neck and suffer extreme pain.

Current devices for solving this problem include neck cushions and a variety of support devices that use straps, hooks or suction cups that secure to the wash basin. However, these devices are disadvantageous for a number of reasons. The neck cushions provide support to the user's head, but do not prevent the neck and head from hyperextending into the wash basin. The alternative support devices are difficult and time consuming to install and/or remove from the wash basin due to the number of parts. Further, these devices are impractical because they do not easily adjust to accommodate the size of the user's head. These devices are also undesirable because the user's hair often gets tangled in the devices during their use.

As such, there is a need in the industry for an apparatus to support a user's head in a wash basin that effectively maintains the user's neck in a neutral and aligned position. There is a further need for a support apparatus that is easily secured to and removed from the wash basin.

SUMMARY

A support apparatus for a head of a user placed in a wash basin is configured to maintain the neck of the user in a neutral position, thereby minimizing head or neck injuries. The support apparatus comprises a base member comprising a cushion member configured to receive the head of the user and a support arm configured to contact a side wall of the wash basin, a leg member comprising a shaft rotatably mounted to a bolt affixed to the base member, the leg member configured to rotatably adjust so the distance between the base member and the leg member is sufficient to enable the bottom portion of the leg member to be in contact with a drain of the wash basin, and a locking mechanism slidably mounted to the shaft and configured to secure the leg member to the base member, wherein the head of the user is supported on the cushion member of the base member such that the neck of the user remains in the neutral position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
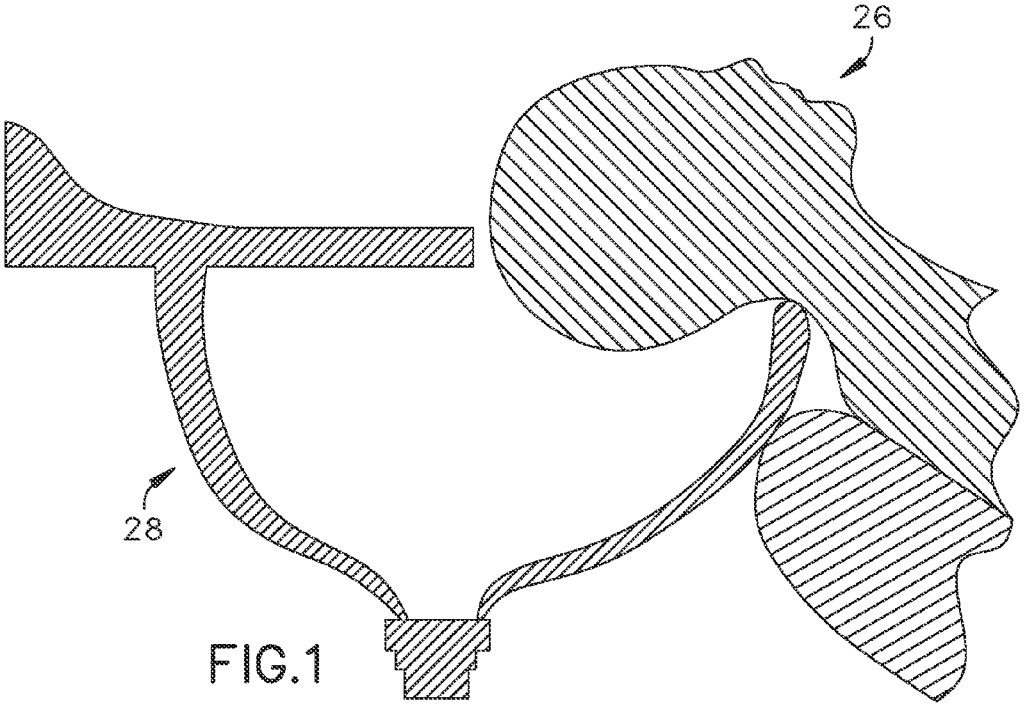
FIG. 1 depicts a section view of demonstrating a user's head in a wash basin without the support apparatus.
Figure 2:
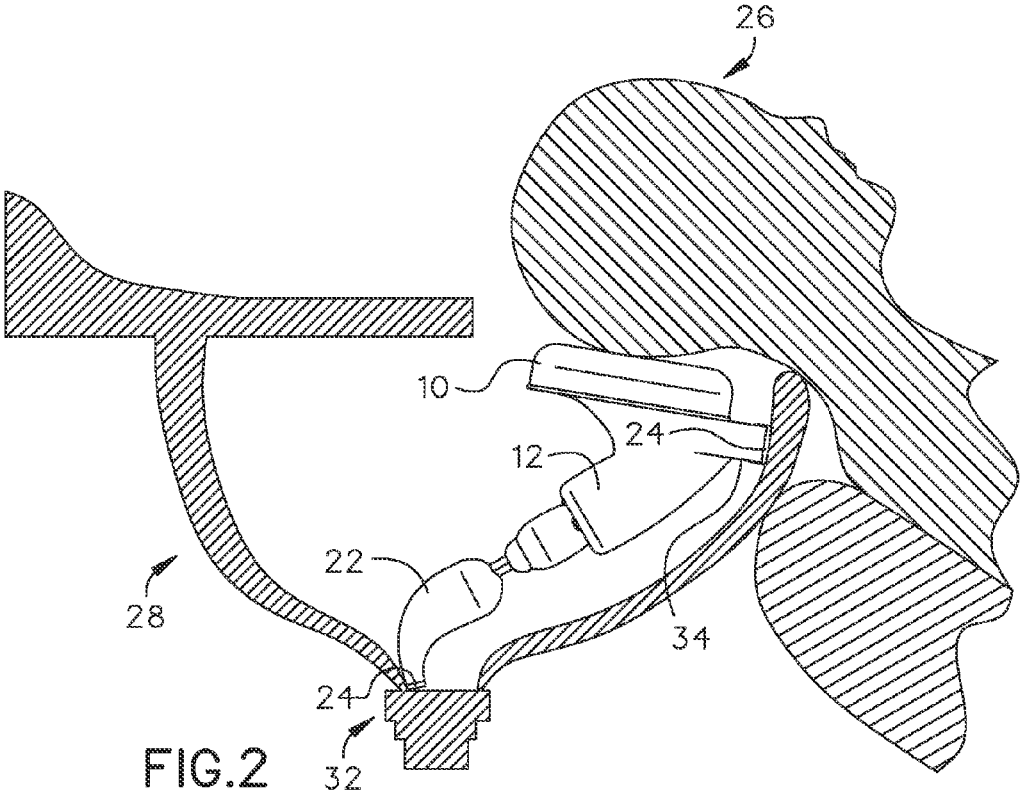
FIG. 2 depicts a section view demonstrating certain embodiments of the support apparatus in use.
Figure 3:
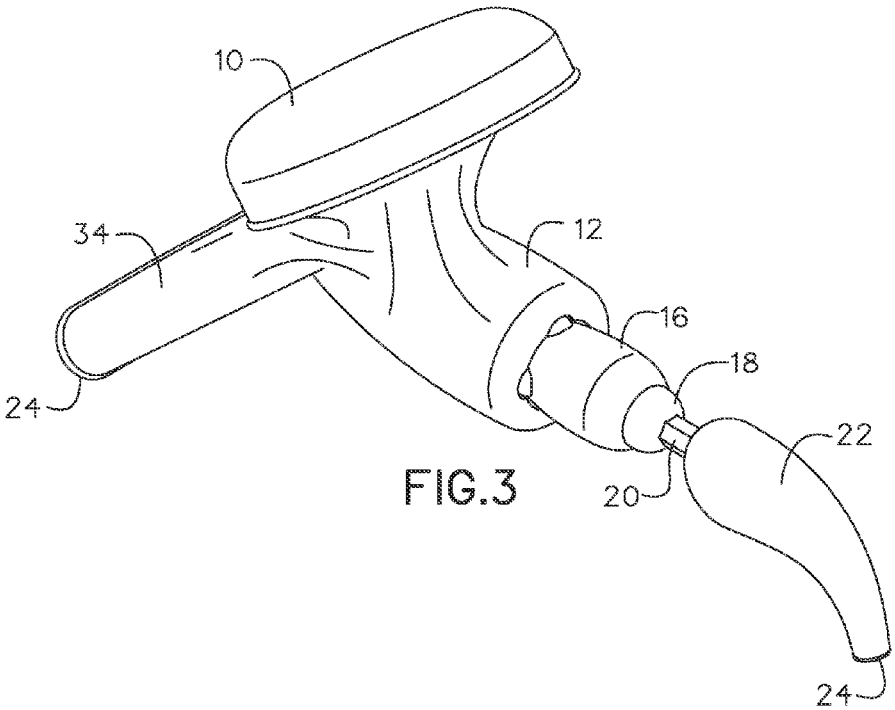
FIG. 3 depicts a rear perspective view of certain embodiments of the support apparatus.
Figure 4:
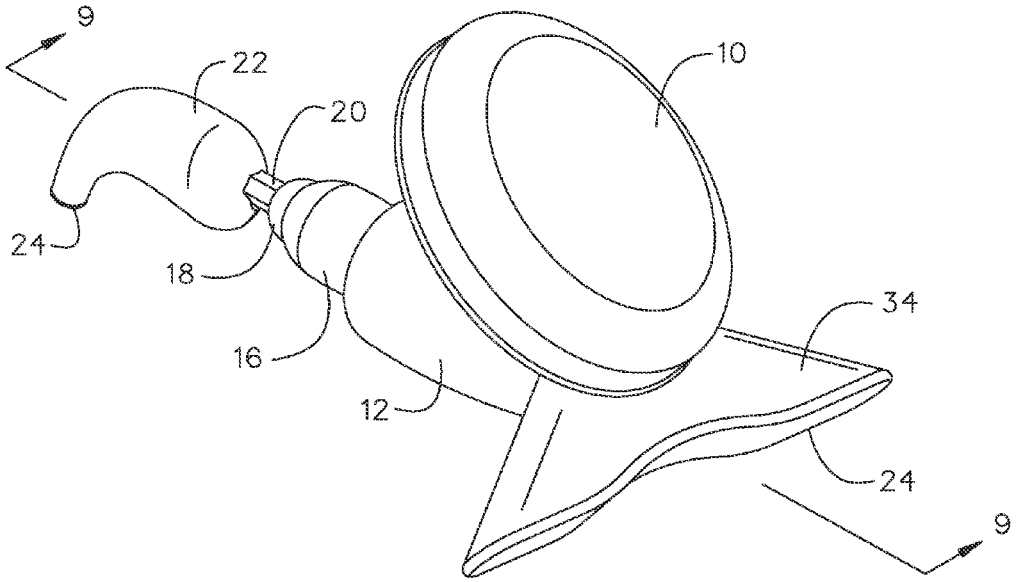
FIG. 4 depicts a front perspective view of certain embodiments of the support apparatus.
Figure 5:
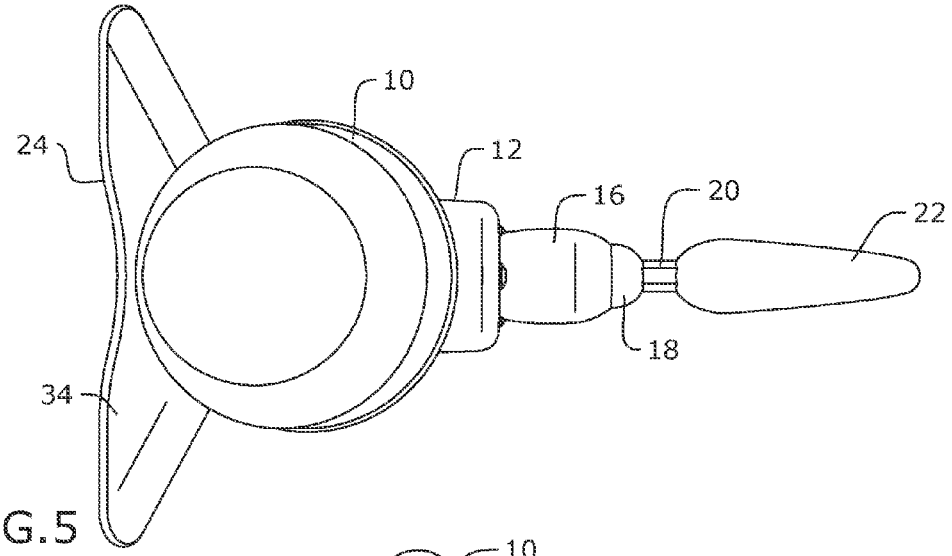
FIG. 5 depicts a top view of certain embodiments of the support apparatus.
Figure 6:
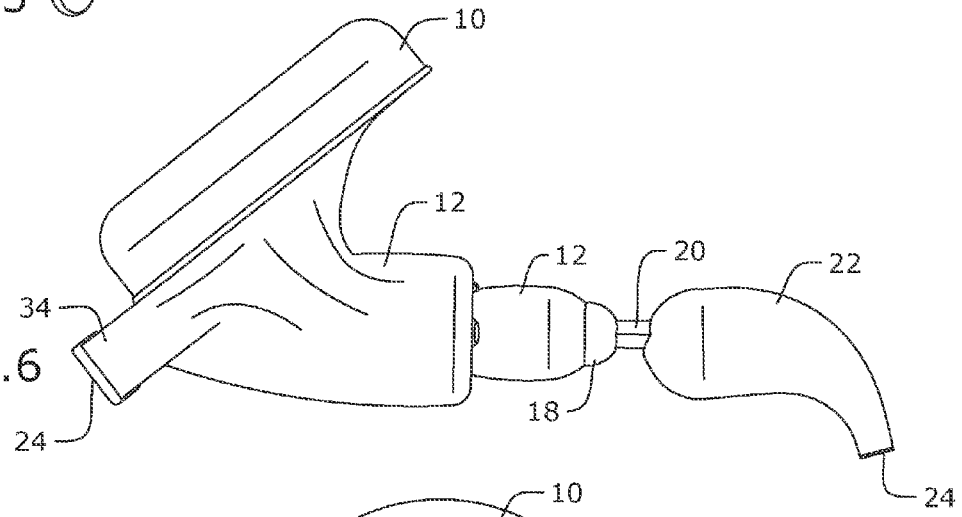
FIG. 6 depicts a side view of certain embodiments of the support apparatus.
Figure 7:
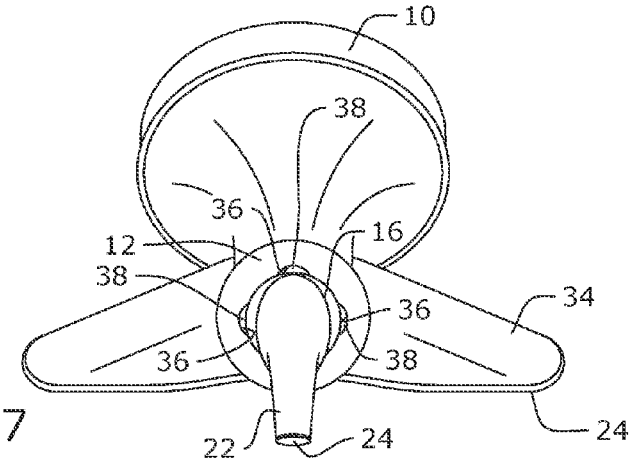
FIG. 7 depicts a front view of certain embodiments of the support apparatus.

As depicted in FIG. 1, exemplary head 26 of a user is placed within wash basin 28. In this configuration, head 26 of the user is hyperextended downward into wash basin 28. As depicted in FIG. 2, the support apparatus comprises cushion 10, main body base 12, spacer arm 34, L-shaped leg 22 and rubberized non-slip coating 24. The support apparatus is disposed within wash basin 28 and oriented such that the rubberized non-slip coating 24 of L-shaped leg 22 is in contact with wash basin drain 32. The rubberized non-slip coating 24 of spacer arm 34 is in contact with the side wall of wash basin 28. These two points of contact secure the support apparatus to the interior of wash basin 28. Head 26 of the user rests on cushion 10. In this configuration, the head and neck of the user is maintained in a neutral and aligned position.

As depicted in FIGS. 3-7, cushion 10, main body base 12, L-shaped leg 22, rubberized non-slip coating 24 and spacer arm 34 of the support apparatus are shown in greater detail. Cushion 10 is affixed to main body base 12, and comprises any soft gel-like material known in the field. Cushion 10 may also comprise a rubber coating to allow the cushion to be water-proof and chemical resistant. Spacer arm 34 comprises a concave opening in the interior portion of the arm and rubberized non-slip coating 24 affixed to the end of the arm. The support apparatus further comprises an elongated aluminum hexagon nut 20 affixed to L-shaped leg 22 by an adhesive such as glue. However, hexagon nut 20 may be made from an alternative metal or polypropylene. Elongated hexagon nut 20 is rotatably mounted to stainless steel machine threaded bolt 14 (not shown in this figure), which is affixed to the interior wall of a concave opening in main body base 12. The threads of stainless steel machine threaded bolt 14 engage with the interior threads of elongated hexagon nut 20. In a preferred embodiment, the interior threads of elongated hexagon nut 20 extend for approximately 1.5 inches from the open end of the nut. It shall be appreciated that alternative materials may also be used for stainless steel bolt 14. For example, the bolt may be zinc plated to make bolt 14 rust resistant.

A locking mechanism comprising hexagon slider 16 and rubber cone washer 18 are both slidably mounted to elongated hexagon nut 20. When hexagon slider 16 is positioned within the concave opening of main body base 12 and rubber cone washer 18 is positioned against hexagon slider 16, the apparatus is in a locked position. This prevents L-shaped leg 22 and elongated hexagon nut 20 from rotating relative to bolt 14.

Figures 8, 9:
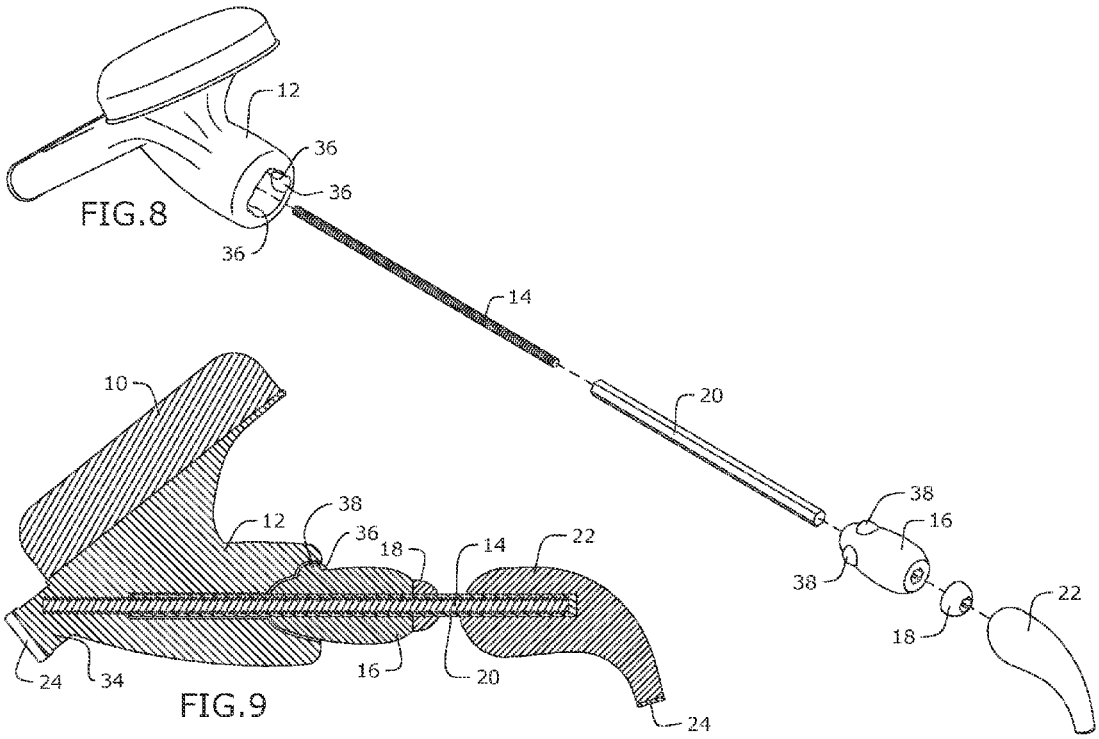
FIG. 8 depicts an exploded view of certain embodiments of the support apparatus.
FIG. 9 depicts a section view of certain embodiments of the support apparatus along line 9-9 in FIG. 4.

As depicted in FIG. 8, an exploded view of several components of the support apparatus are depicted, including main body base 12, stainless steel machine threaded bolt 14, elongated hexagon nut 20, hexagon slider 16, rubber cone washer 18 and L-shaped leg 22. From this view, it is apparent that the concave opening of main body base 12 comprises a plurality of indentations 36. In a preferred embodiment, the concave opening has three indentations 36. Hexagon slider 16 comprises corresponding stabilizers 38 or protrusions disposed on the outer surface of the slider. Hexagon slider 16 further comprises an aperture having a shape that is hexagonal. This allows elongated hexagon nut 20 to slide within the aperture of hexagon slider 16. Similarly, rubber cone washer 18 comprises an aperture, which is configured to allow elongated hexagon nut 20 to slide within the aperture.

FIG. 9 depicts a section view of the support apparatus in a locked position. In this configuration, hexagon slider 16 is positioned such that stabilizers 38 engage with indentations 36 in the concave opening of main body base 12. Rubber cone washer 18 is also positioned against hexagon slider 16. In this locked position, L-shaped leg 22 and elongated hexagon nut 20 cannot rotate relative to threaded bolt 14. To unlock the apparatus, a user slides hexagon slider 16 out of main body base 12. This allows a user to rotate hexagon nut 20 relative to threaded bolt 14, which increases or decreases the distance between main body base 12 and L-shaped leg 22. The user rotates hexagon nut 20 counter-clockwise to extend the distance between main body base 12 and L-shaped leg 22 or clockwise to shorten the distance between main body base 12 and L-shaped leg 22. Since the interior threads of elongated hexagon nut 20 extend for approximately 1.5 inches from the open end of the nut, the distance between main body base 12 and L-shaped leg 22 can be increased or decreased by approximately 1.5 inches. It shall be appreciated that the inner threads of elongated hexagon nut 20 may be disposed over a greater length of the nut to allow for greater adjustments in length to the support apparatus. To lock the apparatus in a desired position, the user slides hexagon slider 16 and rubber cone washer 18 back to the locked position described above.

In operation, a user unlocks the support apparatus by sliding hexagon slider 16 out of main body base 12. This also slides rubber cone washer 18 away from main body base 12. The user rotates L-shaped leg 22 and elongated hexagon nut 20 until a desired distance between main body base 12 and L-shaped leg 22 is achieved. In particular, the distance should be sufficient to allow L-shaped leg 22 to be in contact with wash basin drain 32 and spacer arm 34 to be in contact with the side wall of wash basin 28. Once the support apparatus is adjusted properly, the user slides hexagon slider 16 and rubber cone washer 18 back to the locked position. The support apparatus is secured within wash basin 28. In this configuration, head 26 of the user rests on cushion 10. The head and neck of the user is maintained in a neutral and aligned position. In this position, the user does not experience any pain and has a full-range of motion of his/her head and neck.

It shall be appreciated that the components of the support apparatus described in several embodiments herein may comprise any known materials in the field and be of any color, size and/or dimensions. For example, main body base 12, hexagon slider 16 and L-shaped leg 22 may be made from plastic, epoxy putty, or the like. This allows the support apparatus to accommodate any user and variety of wash basins. It shall be appreciated that the components of the support apparatus described herein may be manufactured and assembled using any known techniques in the field. It shall be appreciated that the support apparatus may be used in any variety of applications including, but not limited to, hair washing, application of makeup, facial waxing, or the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A support apparatus for a head of a user placed in a wash basin, the support apparatus being configured to maintain the neck of the user in a neutral position to minimize head or neck injuries, the support apparatus comprising:

a base member comprising a cushion member configured to receive the head of the user, a support arm configured to contact a side wall of the wash basin, and a concave opening comprising a plurality of indentations disposed therein on an inner wall;

a leg member comprising a generally elongated hexagonal nut rotatably mounted to a bolt affixed to the base member within the concave opening, the leg member configured to rotatably adjust so a distance between the base member and the leg member is sufficient to enable a bottom portion of the leg member to be in contact with a drain of the wash basin; and a locking mechanism comprising a slider member slidably mounted to the elongated hexagonal nut, the slider member comprising a plurality of outer stabilizers configured to slidably engage with the plurality of indentations within the concave opening to secure the leg member to the base member, wherein the head of the user is supported on the cushion member of the base member such that the neck of the user remains in the neutral position.

2. The support apparatus of claim 1, further comprising a rubber cone washer slidably mounted to the hexagonal nut.

3. The support apparatus of claim 2, further comprising a non-slip rubberized layer affixed to both the support arm of the base member and the bottom portion of the leg member.

* * * * *